US006142318A

United States Patent [19]

Tooma

[11] Patent Number: 6,142,318

[45] **Date of Patent: *Nov. 7, 2000**

[54] TOOTHBRUSH HOLDER WITH PARTITIONS

[76] Inventor: William Tooma, 41 Allen Dr., North Arlington, N.J. 07031

[ * ] Notice: This patent is subject to a terminal disclaimer.

[21] Appl. No.: 08/918,806

[22] Filed: Aug. 26, 1997

Related U.S. Application Data

[63] Continuation-in-part of application No. 08/420,228, Apr. 11, 1995, Pat. No. 5,660,285.

[51] Int. Cl.[7] ..... A47B 81/02

[52] U.S. Cl. ..... 211/65; 206/362; 220/337; 220/339; D6/528; D6/534

[58] Field of Search ..... 211/65, 66, 87; 248/110; 206/361, 362, 362.1, 362.2, 362.3, 368, 369; 220/337, 339; D6/528, 534; D26/82

[56] References Cited

U.S. PATENT DOCUMENTS

| | | | |
|---|---|---|---|
| D. 183,987 | 11/1958 | Jones | D6/528 |
| D. 207,630 | 5/1967 | Jomes | D6/528 |
| D. 234,036 | 1/1975 | Nixon | D6/528 |
| D. 234,481 | 3/1975 | McLeod | D6/534 |
| 2,592,131 | 4/1952 | Farrar | D6/534 X |
| 2,965,109 | 12/1960 | Borah | D6/528 X |
| 3,746,162 | 7/1973 | Bridges | D6/534 X |
| 4,880,020 | 11/1989 | Schurgin | 206/362.3 X |
| 4,964,683 | 10/1990 | Sugarek et al. | D6/528 X |
| 5,375,711 | 12/1994 | Bree et al. | 206/361 X |
| 5,377,824 | 1/1995 | Seymour | 206/362.1 X |
| 5,522,497 | 6/1996 | Stacy | 206/362.1 X |

*Primary Examiner*—Daniel P. Stodola
*Assistant Examiner*—Richard M. Smith
*Attorney, Agent, or Firm*—R. Neil Sudol; Henry D. Coleman

[57] ABSTRACT

A toothbrush holder device has a generally hemispherical support member having a hemispherically concave inner surface tapering down to a drainage hole in a lowermost part of the support member. The support member is provided with a plurality of apertures each traversable by a toothbrush handle. The apertures perforate or traverse the inner surface and are upwardly spaced from the hole and angularly spaced from one another about an axis of the support member. A plurality of partitions on the support member extend away from the inner surface of the support member. The partitions serve to at least partially isolate or separate toothbrushes which are resting on the inner surface of the support member and which have respective handles inserted through respective apertures. Preferably, the partitions are radially oriented inserted and are disposed between respective adjacent ones of the apertures.

20 Claims, 8 Drawing Sheets

TOOTHBRUSH HOLDER WITH PARTITIONS

CROSS-REFERENCE TO RELATED APPLICATION

This application is a continuation-in-part of application Ser. No. 08/420,228 filed Apr. 11, 1995, now U.S. Pat. No. 5,660,285.

BACKGROUND OF THE INVENTION

This invention relates to a toothbrush holder.

In the home and in public accommodations such as hotels, toothbrushes are generally stored on holders having apertures or recesses for receiving the handles of the brushes. The bristles of the toothbrush heads rest on the upper surfaces of the supports. This conventional structure gives rise to a significant potential for disease transmission, particularly in hotels and other public guest facilities, unless special attention is paid to cleaning and sterilizing the toothbrush holders.

Another characteristic of conventional toothbrush holders is that the toothbrushes are exposed and therefore capable of acquiring microorganisms from mouth spray which is incidental to tooth cleaning.

OBJECTS OF THE INVENTION

An object of the present invention is to provide a toothbrush holder which reduces the chances of disease transmission.

Another object of the present invention is to provide such a toothbrush holder which is disposable.

Another, related, object of the present invention is to provide such a toothbrush holder which is inexpensive.

A further object of the present invention is to provide such a toothbrush holder which protects the brush and reduces, if not eliminates, the chances of acquisition of air-borne microorganisms.

Yet another object of the present invention is to provide a toothbrush holder which can be carried with the toothbrush during travel.

These and other objects of the present invention will be apparent from the drawings and detailed descriptions herein.

SUMMARY OF THE INVENTION

A toothbrush holder device comprises, in accordance with the present invention, a generally hemispherical support member having a hemispherically concave inner surface tapering down to a drainage hole in a lowermost part of the support member. The support member is provided with a plurality of apertures each traversable by a toothbrush handle. The apertures perforate or traverse the inner surface and are upwardly spaced from the hole and angularly spaced from one another about an axis of the support member.

According to further features of the present invention, the toothbrush holder further comprises an element on the support member for attaching the support member to a stationary fixture, and a hemispherical lid member movably attached to the support member. Preferably, the lid member is hingedly secured to the support member and is provided with a latch element for releasably locking the lid member to the support member.

According to another feature of the present invention, the support member is provided with a plurality of partitions extending away from the inner surface of the support member, the partitions serving to at least partially isolate or separate toothbrushes which are resting on the inner surface of the support member and which have respective handles inserted through respective apertures. A plurality of partitions on the support member extend away from the inner surface of the support member. Preferably, the partitions are radially oriented and are disposed between respective adjacent ones of the apertures.

In a specific embodiment of the invention, the apertures are four in number and the partitions are likewise four in number, the partitions being angularly equispaced about the axis of the support member.

A toothbrush holder in accordance with the present invention reduces the chances of disease transmission. The lid serves to create an enclosure for the toothbrush bristles, thereby shielding the bristles from air-borne microorganisms and cleaning products. The partitions serve to isolate the toothbrush heads from one another, thereby inhibiting or preventing the spread of bacteria from brush to brush.

The toothbrush holder is utilizable in the home, as well as in public facilities such as resorts, commercial hotels, luxury liners, hospitals, and other medical and health institutions.

Because a toothbrush holder in accordance with the present invention is disposable, the entire holder may be removed from a bathroom fixture for replacement by a new, sterile, holder. This feature is particularly advantageous in maintaining the cleanliness of public accommodations. As an added advantage, the hotel customer may take the toothbrush holder along upon vacating a room. The holder can be carried in a purse or overnight bag, with the toothbrush stored inside the enclosure defined by the support member and the lid. This protects both the toothbrush and the other contents of the purse or bag from cross-contamination.

A toothbrush holder in accordance with the present invention is simple to manufacture and accordingly inexpensive. The various components of the device may be of injection molded polymeric material. After use, the material may be sterilized and recycled.

DETAILED DESCRIPTION

Figure 1:
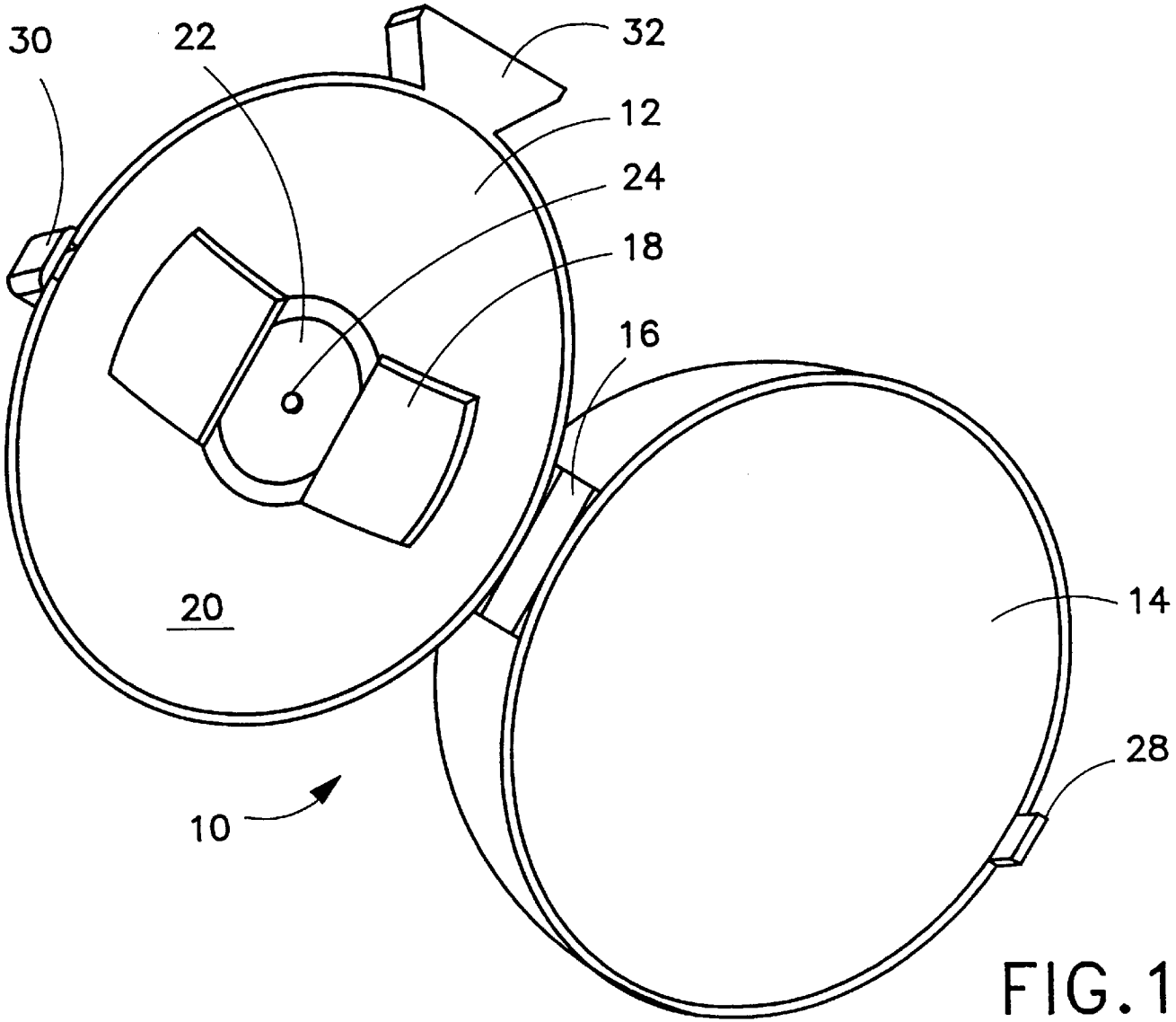
FIG. 1 is a top, front, and right side perspective view of a toothbrush holder in accordance with the present invention, showing the toothbrush holder in an opened configuration.
Figure 2:
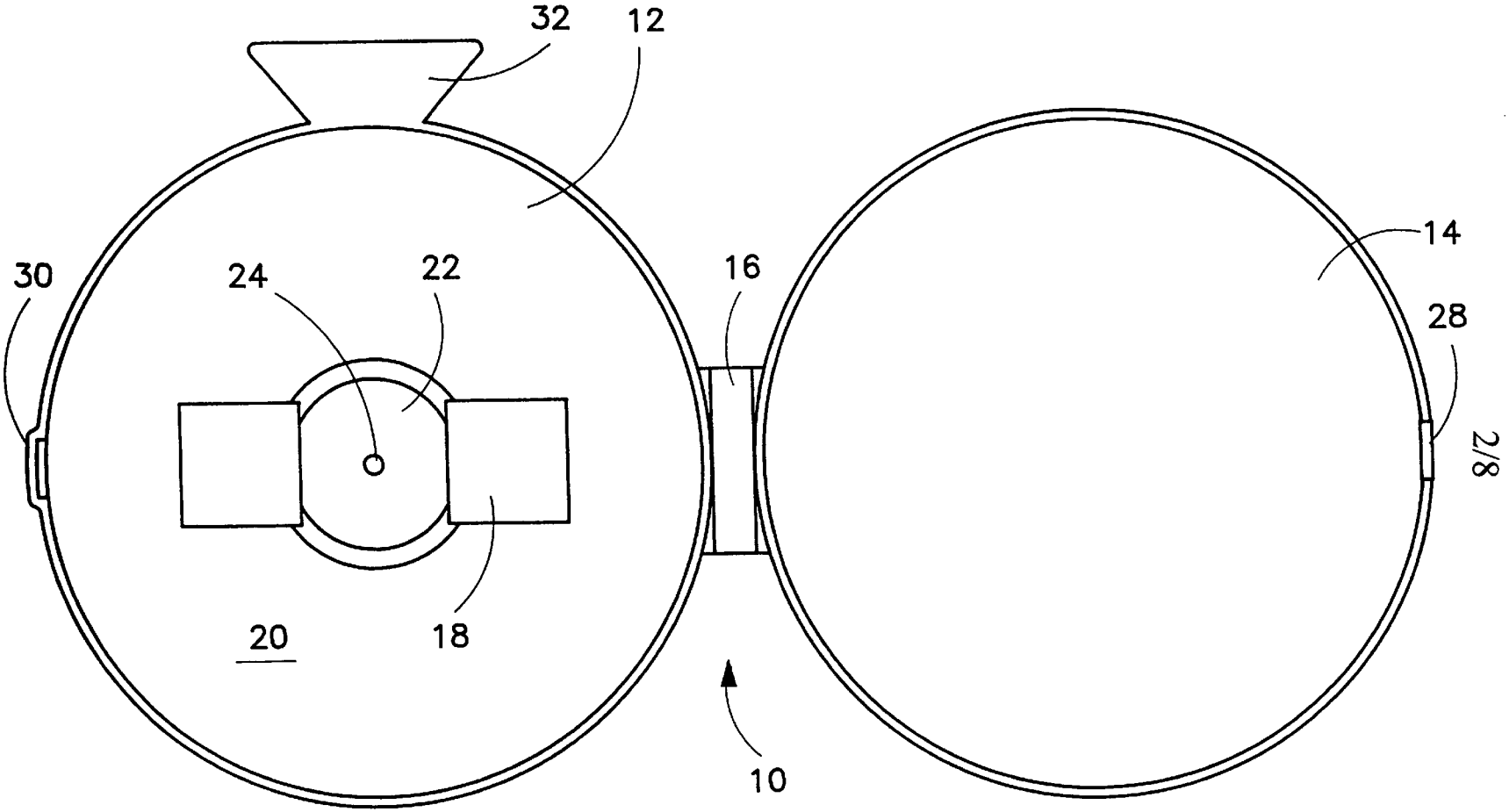
FIG. 2 is a top plan view thereof.
Figure 3:
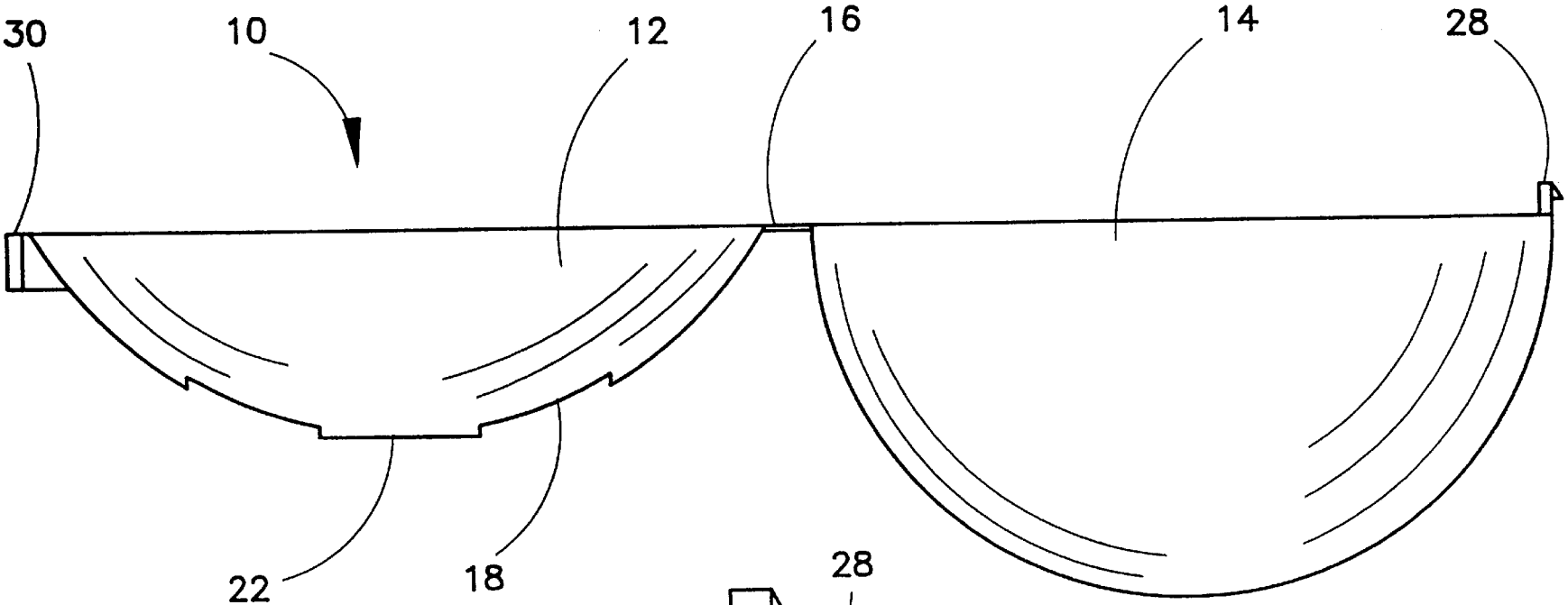
FIG. 3 is a right side elevational view thereof.
Figure 4:
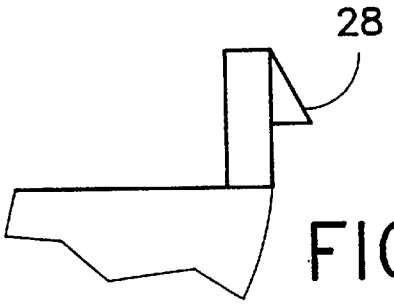
FIG. 4 is a side elevational view of a detent or latch of the toothbrush holder of FIGS. 1–3.
Figure 5:
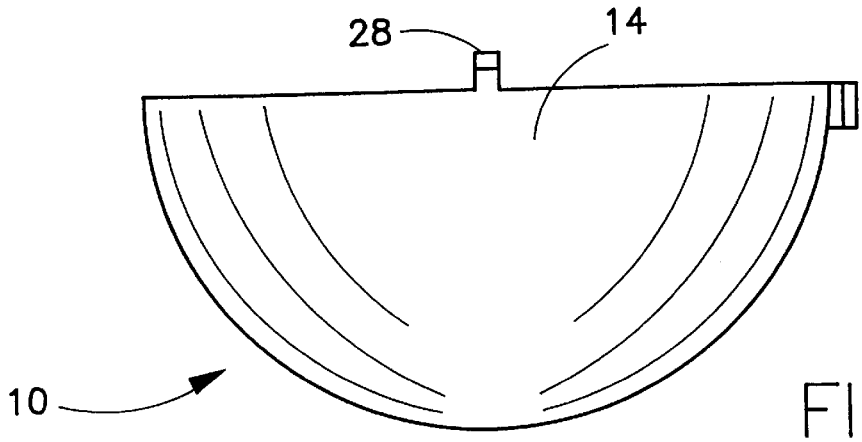
FIG. 5 is a rear elevational view of the toothbrush holder of FIGS. 1–3.
Figure 6:
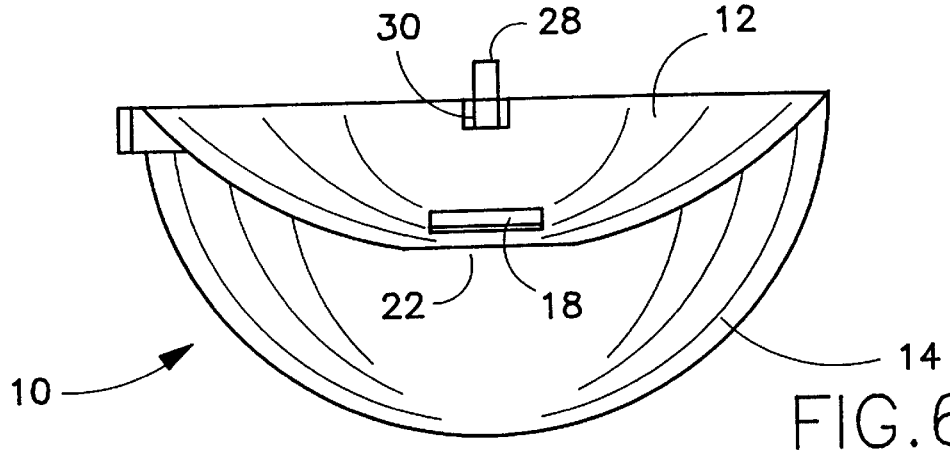
FIG. 6 is a front elevational view thereof.
Figure 7:
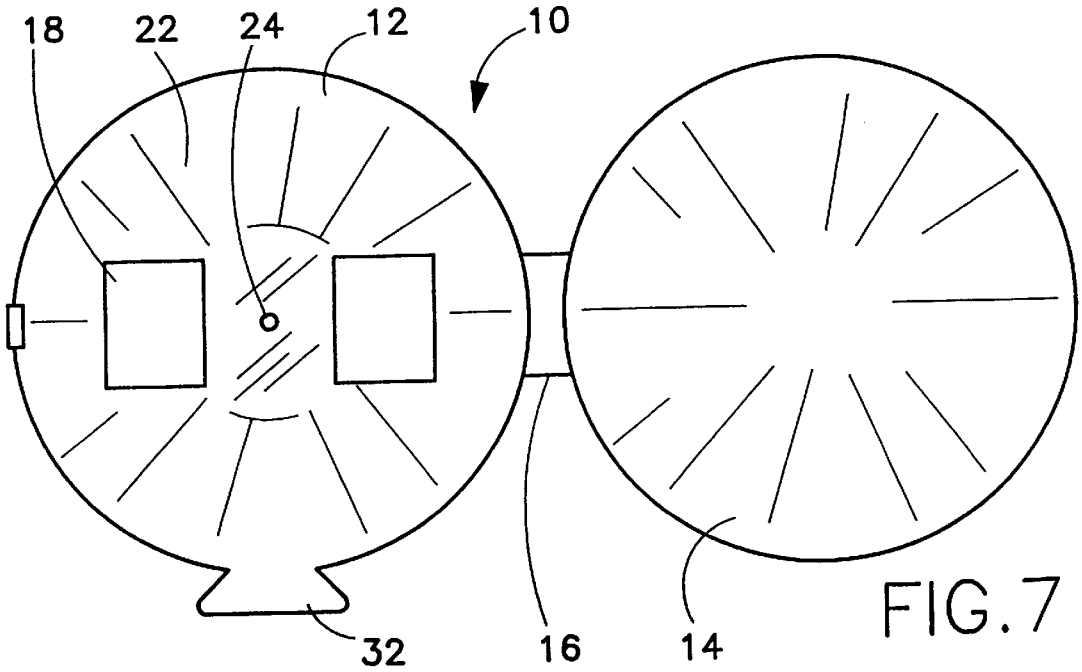
FIG. 7 is a bottom plan view thereof.

As illustrated in the drawings, a toothbrush holder 10 comprises a generally cup-shaped support member 12 and a generally cup-shaped lid member 14 attached to one another via a hinge section 16. Support member 12 is provided with at least one and preferably a plurality of rectangular apertures 18 each traversable by a respective toothbrush handle (not shown). After use of a toothbrush, a handle of the brush is inserted generally vertically downwardly through a respective aperture 18. The bristles (not shown) of the toothbrush rest on an inner, concave surface 20 of support member 12.

Support member 12 is formed with a flattened lower, central section 22 which in turn is provided centrally with a hole 24 for enabling drainage of fluid from support member 12 and for enhancing drying air flow through the holder 10.

Lid member 14 is movably attached to support member 12 via hinge section 16 so as to be shiftable between a closure position (not shown) covering support member 12 and a toothbrush head (not shown) on support member 12 and an opened position (shown in the drawings) providing access to support member 12 and a toothbrush supported thereby.

Although it is contemplated that the drainage structure of support member 12, namely, central section 22 and hole 24, is different and spaced from each aperture 18, it is possible to drain fluid through the apertures themselves. Of course, in that case, apertures 18 are located at lowermost points of support member 12.

It is to be noted that toothbrush holder 10 may be provided with but a single aperture 18. Alternatively, support member 12 may be formed with more than two such apertures 18. Each toothbrush-receiving aperture 18 is radially spaced from drainage hole 24 and angularly spaced from the other apertures about an axis 26 of support member 12.

Lid member 14 and support member 12 may approximate spherical sections.

A snap-lock detent or latch 28 is provided on lid member 14 for cooperating with a recess 30 on support member 12 to releasably lock the lid member to the support member. Generally, it is contemplated that hinge section 16 operates as a spring to automatically open the toothbrush holder 10 upon a releasing of detent 28 from recess 30.

Toothbrush holder device further includes a toothed element 32 on support member 12 for attaching the support member to a stationary fixture (not shown) via a receptacle element 34. Receptacle element 34 is provided with a recess 36 for the removable insertion of toothed element 32 and is attachable, for example, via an adhesive layer (not shown) or hook and loop fasteners (VELCRO) to tiles or other bathroom surfaces.

In toothbrush holder 10, lid member 14 serves to create an enclosure for toothbrush bristles, thereby shielding the bristles from the spray which is incidental to teeth cleaning and from other air-borne microorganisms. Toothbrush holder 10 is disposable and accordingly the entire holder may be removed from a bathroom fixture for replacement by a new, sterile, holder.

Figure 10:
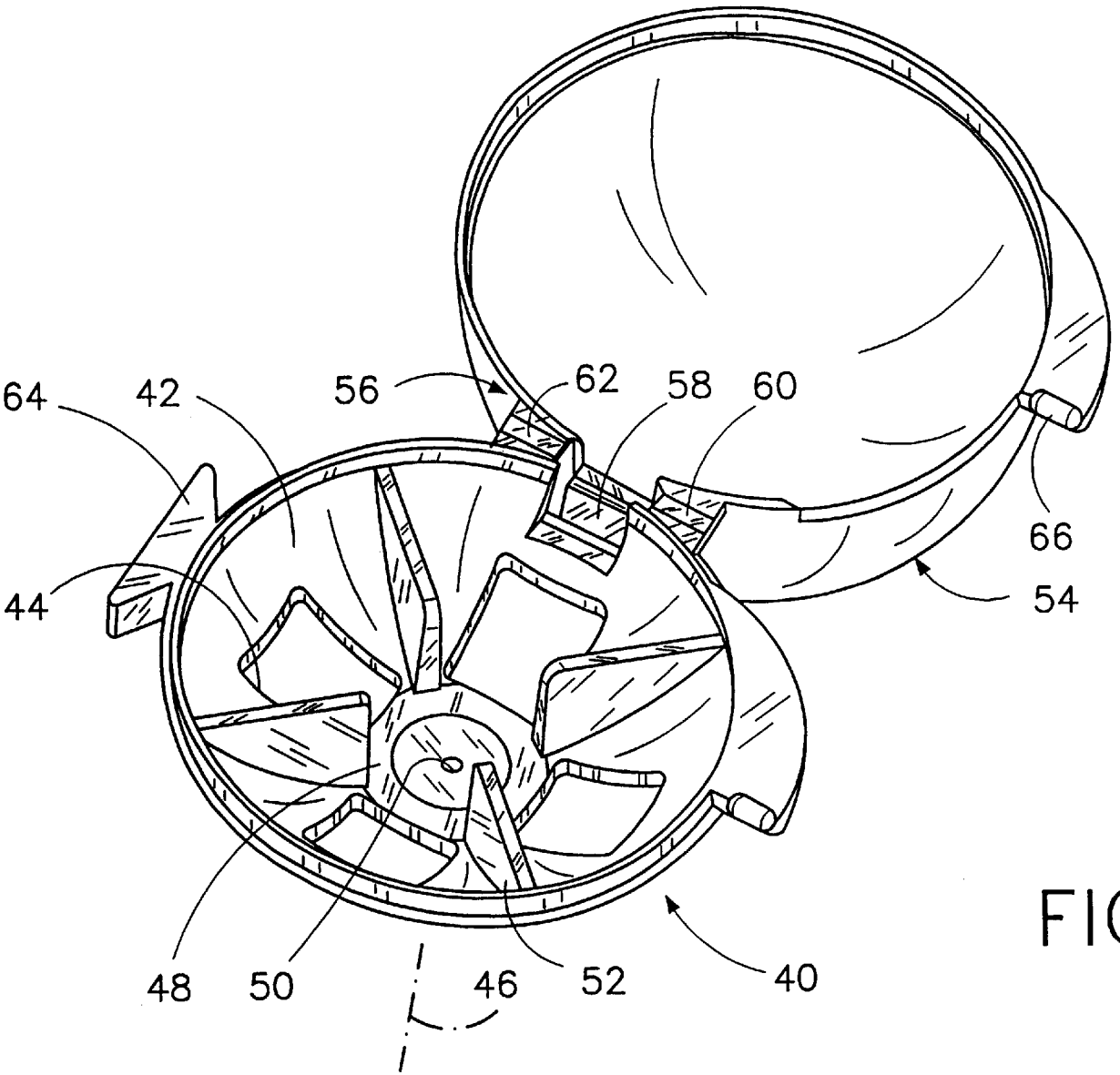
FIG. 10 is a perspective view of another embodiment of a toothbrush holder in accordance with the present invention, showing the toothbrush holder in an opened configuration.
Figure 12:
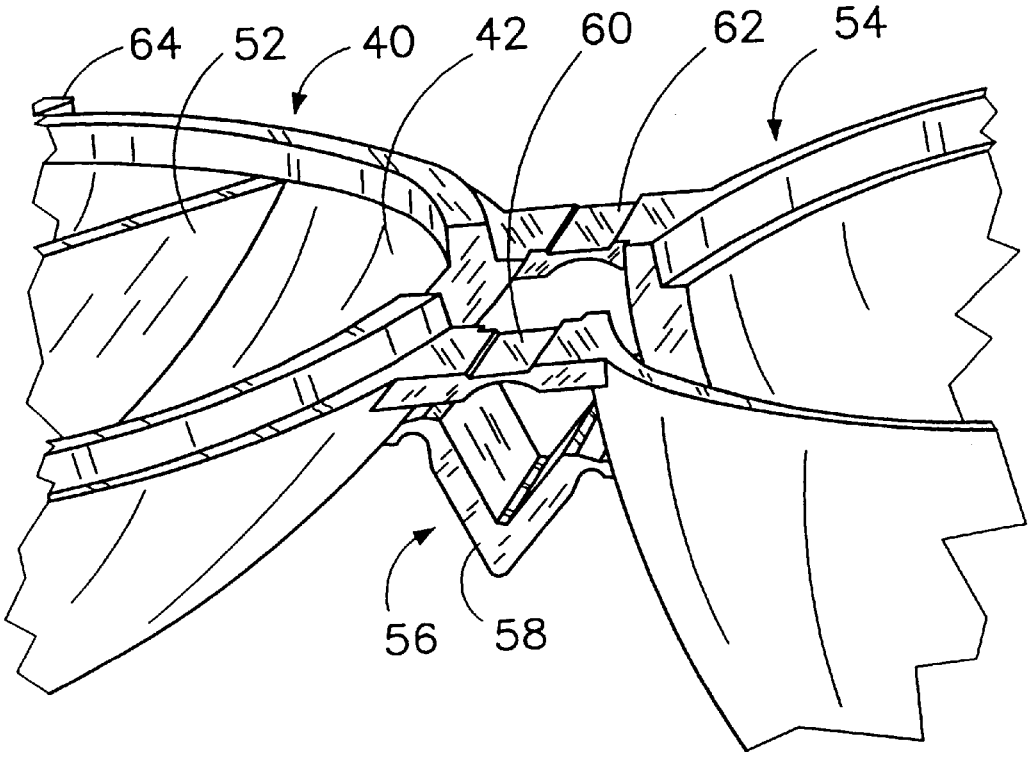
FIG. 12 is a top plan view of the open configuration of the toothbrush holder of FIGS. 10 and 11.
Figure 11:
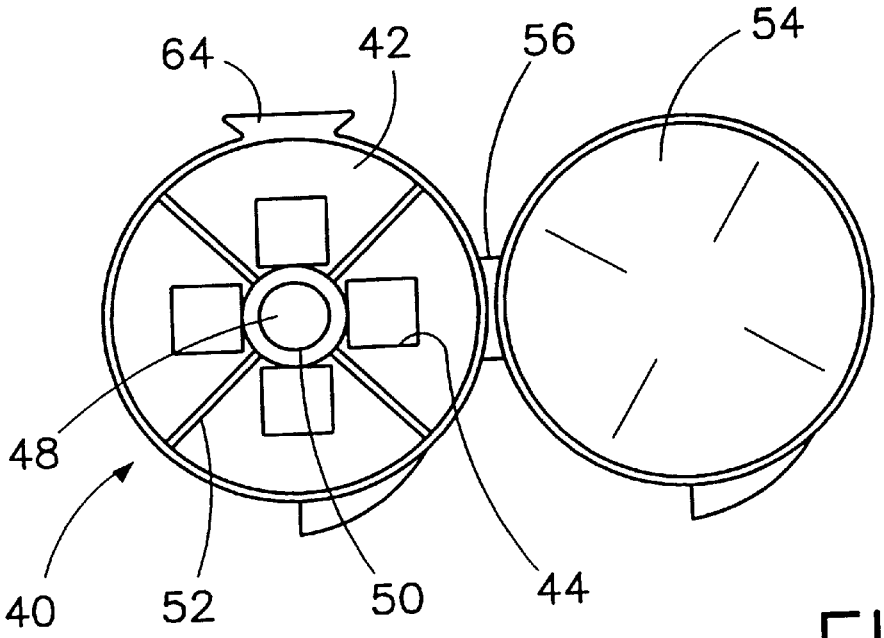
FIG. 11 is a partial perspective view, on an enlarged scale, showing a so-called living hinge included in the toothbrush holder of FIG. 10.

As illustrated in FIGS. 10–12, a modified embodiment of a toothbrush holder comprises a support member 40 which is approximately hemispherical or, more accurately, approximates a spherical section. Support member 40 is provided in a hemispherically or spherically curved surface or panel 42 with four rectangular apertures 44 which are angularly equispaced about an axis 46 of the support member. In the use of the toothbrush holder to store toothbrushes, apertures 44 are traversed by handles of respective toothbrushes, with bristled heads of the toothbrushes resting on surface or panel 42.

In a flattened lower portion 48, surface or panel 42 is formed with a drainage hole 50 for channeling aqueous drippings from the support member. Apertures 44 are radially and upwardly spaced along surface or panel 42 from drainage hole 50.

Apertures 44, and concomitantly, any toothbrushes which they may be holding, are partially separated or isolated from each other by a plurality of planar partitions 52. Partitions 52 are angularly equispaced about axis 46 and extend upwardly from surface or panel 42 in respective radial planes relative to axis 46.

The toothbrush holder of FIGS. 10–12 further comprises a hemispherical lid 54 swivelably connected to support member 40 via a so-called living hinge 56. Hinge 56 includes a central folding spring section 58 flanked by a pair of fold-line hinge portions 60 and 62. Hinge 56 is integrally molded with support member 40 and lid 54.

Figure 8:
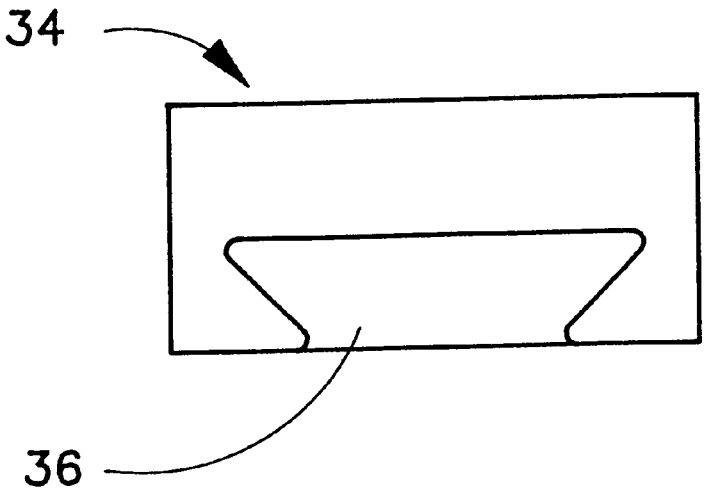
FIG. 8 is a top plan view of an attachment or coupling element on the toothbrush holder of FIGS. 1–3 and 5–7.
Figure 9:
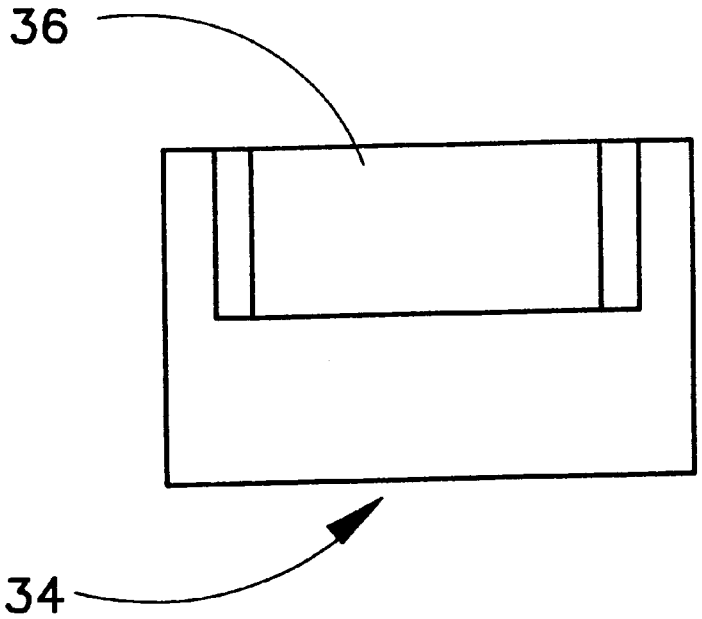
FIG. 9 is a side elevational view of the attachment or coupling element of FIG. 8.

The toothbrush holder of FIGS. 10–12 also comprises a toothed element 64 on support member 40 for attaching the support member to a stationary fixture (not shown) via receptacle element as discussed above with reference to FIGS. 8 and 9. A snap-lock detent or latch 66 is provided on lid 54 or support member 40 for cooperating with a recess (not shown) on support member 40 or lid 54 to releasably lock the lid member to the support member. Generally, it is contemplated that hinge section 58 operates as a spring to automatically open the toothbrush holder upon a releasing of detent 66 from the cooperating recess.

Figure 13:
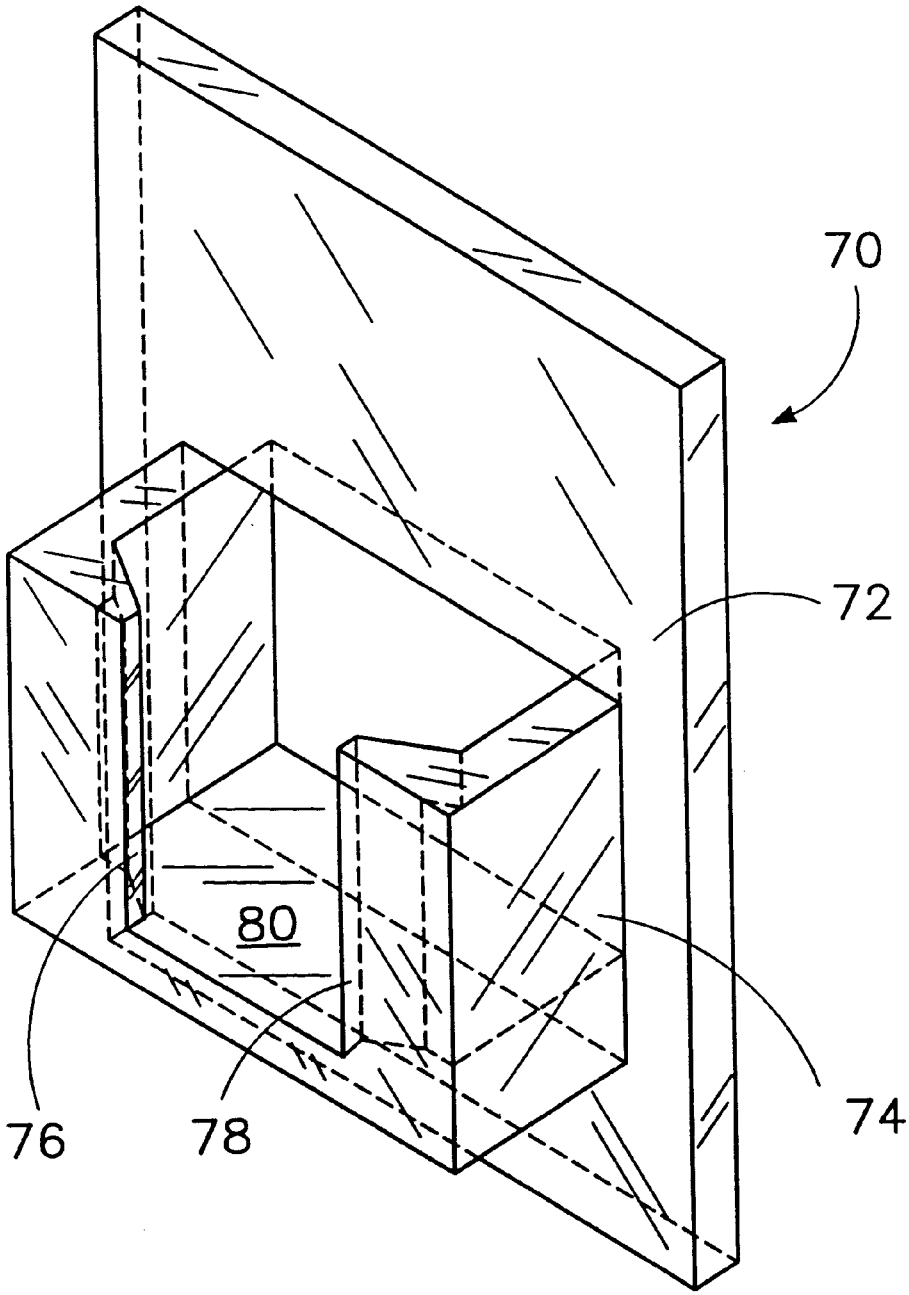
FIG. 13 is a perspective view of a fixture attachable to a wall surface for mounting the toothbrush holder or FIG. 1 or of FIGS. 10–12 to the wall surface.

As illustrated in FIG. 13, a fixture 70 attachable to a wall surface (not shown) for mounting the toothbrush holder or FIG. 1 or of FIGS. 10–12 to the wall surface includes a plate 72 and a U-shaped bracket 74 provided along vertical outer edges with a pair of inwardly facing flanges 76 and 78. U-shaped bracket 74 and flanges 76 and 78 define a recess 80 for receiving toothed element 32 or 64.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A toothbrush holder device comprising a generally hemispherical support member having a hemispherically concave inner surface tapering down to a drainage hole in a lowermost part of said support member, said support member being provided with a plurality of apertures each traversable by a toothbrush handle, said apertures traversing said inner surface, said apertures being upwardly spaced from said hole and angularly spaced from one another about an axis of said support member.

2. The device defined in claim 1, further comprising means on said support member for attaching said support member to a stationary fixture.

3. The device defined in claim 2, further comprising a hemispherical lid member movably attached to said support member.

4. The device defined in claim 3 wherein said lid member is hingedly secured to said support member.

5. The device defined in claim 3, further comprising means on said support member and said lid member for releasably locking said lid member to said support member.

6. The device defined in claim 2, further comprising a plate mountable to the stationary fixture, said plate being provided with a recess, said means for attaching including a tooth extending from said support member and insertable into said recess.

7. The device defined in claim 1 wherein said support member is provided with a plurality of partitions extending away from said inner surface for at least partially isolating toothbrushes resting on said inner surface and having respective handles inserted through respective ones of said apertures.

8. The device defined in claim 7 wherein said partitions are radially oriented and are disposed between respective adjacent ones of said apertures.

9. The device defined in claim 8 wherein said apertures are four in number and said partitions are likewise four in number, said partitions being angularly equispaced about said axis.

10. A toothbrush holder device comprising a generally cup-shaped support member having a concave inner or upper surface provided with a plurality of spaced apertures each traversable by a respective toothbrush handle, said support member being provided with a plurality of partitions each extending upwardly from said inner or upper surface between adjacent ones of said apertures for at least partially separating or isolating, from one another, toothbrush heads disposed on said inner or upper surface with respective handles traversing said adjacent respective ones of said apertures.

11. The device defined in claim 10, further comprising a lid member movably attached to said support member so as to be shiftable between a closure position covering said support member and toothbrush heads on said support member and an opened position providing access to said support member and a toothbrush supported thereby.

12. The device defined in claim 11 wherein said support member and said lid member approximate spherical sections.

13. The device defined in claim 11 wherein said lid member is hingedly secured to said support member.

14. The device defined in claim 11, further comprising means on said support member and said lid member for releasably locking said lid member to said support member.

15. The device defined in claim 10 wherein a hole is provided in a lowermost part of said inner or upper surface, said apertures being provided at positions upwardly spaced from said hole along said inner or upper surface.

16. The device defined in claim 15 wherein each of said apertures is radially spaced from said hole and angularly spaced from each other of said apertures about an axis of said support member.

17. The device defined in claim 10 wherein said apertures are substantially rectangular.

18. The device defined in claim 10, further comprising means on said support member for attaching said support member to a stationary fixture.

19. The device defined in claim 10, further comprising means on said support member and said lid member for releasably locking said lid member to said support member.

20. The device defined in claim 10 wherein said support member is hemispherical and said partitions are radially oriented.

* * * * *